US008851599B2

(12) United States Patent
Tanase et al.

(10) Patent No.: US 8,851,599 B2
(45) Date of Patent: Oct. 7, 2014

(54) PRINT CONTROL DEVICE AND PROGRAM

(71) Applicant: Seiko Epson Corporation, Tokyo (JP)

(72) Inventors: Kazuyoshi Tanase, Nagano (JP); Toru Takahashi, Nagano (JP); Takamitsu Kondo, Nagano (JP); Hiroshi Wada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/860,816

(22) Filed: Apr. 11, 2013

(65) Prior Publication Data

US 2013/0278670 A1 Oct. 24, 2013

(30) Foreign Application Priority Data

Apr. 23, 2012 (JP) ..... 2012-097841

(51) Int. Cl.

| | |
|---|---|
| ***B41J 29/38*** | (2006.01) |
| ***B41J 29/393*** | (2006.01) |
| ***B41J 2/015*** | (2006.01) |
| ***B41J 2/21*** | (2006.01) |

(52) U.S. Cl.

CPC ..... *B41J 2/2132* (2013.01); *B41J 2/2135* (2013.01)

USPC ..... 347/9; 347/19; 347/20

(58) Field of Classification Search

CPC ..... B41J 2029/3935; B41J 2/13

USPC ..... 347/9, 19–20

See application file for complete search history.

(56) References Cited

U.S. PATENT DOCUMENTS

| | | | | |
|---|---|---|---|---|
| 2003/0085974 | A1 | 5/2003 | Shimomura et al. | |
| 2004/0017406 | A1 | 1/2004 | Kato et al. | |
| 2004/0092621 | A1 | 5/2004 | Kataoka et al. | |
| 2005/0185012 | A1 | 8/2005 | Yoshida | |
| 2010/0214347 | A1* | 8/2010 | Sasayama | 347/19 |

FOREIGN PATENT DOCUMENTS

| | | | |
|---|---|---|---|
| JP | 2003-191601 | A | 7/2003 |
| JP | 2003-266912 | A | 9/2003 |
| JP | 2003-266913 | A | 9/2003 |
| JP | 2003-266932 | A | 9/2003 |
| JP | 2003-286428 | A | 10/2003 |
| JP | 2005-205691 | A | 8/2005 |

* cited by examiner

*Primary Examiner* — Jason Uhlenhake

(74) *Attorney, Agent, or Firm* — Global IP Counselors, LLP

(57) ABSTRACT

A plurality of test patterns that are disposed in a predetermined direction are printed using dot arrays formed along an intersecting direction interesting with the predetermined direction using nozzles included in an overlapping portion of a first nozzle array and a second nozzle array, a plurality of rules lined in the predetermined direction are printed so as to be adjacent to the test patterns using nozzles included in the first nozzle array and the second nozzle array, density correction values are computed according to density of each of raster lines of the test patterns, and the positions of nozzles specified from the positions of rules are associated with the positions of the raster lines for which density correction values are computed.

8 Claims, 16 Drawing Sheets

FIG. 12

| HEAD NUMBER | NOZZLE NUMBER | ARRAY REGION NUMBER |
|---|---|---|
| 42A (M) | #1 | 1 |
| | ⋮ | ⋮ |
| | #i | x |
| | ⋮ | ⋮ |
| 42B (M) | #1 | ⋮ |
| | ⋮ | ⋮ |
| | #1 | x' |
| | ⋮ | ⋮ |

| HEAD NUMBER | NOZZLE NUMBER | RASTER NUMBER OF CONCENTRATION CORRECTION | CONCENTRATION CORRECTED VALUE |
|---|---|---|---|
| 42A (M) | #1 | 1 | $C_1$ |
| | ⋮ | ⋮ | ⋮ |
| | #i | k | $C_k$ |
| | ⋮ | ⋮ | ⋮ |
| 42B (M) | #1 | ⋮ | ⋮ |
| | ⋮ | ⋮ | ⋮ |
| | #i | k' | $C_{k'}$ |
| | ⋮ | ⋮ | ⋮ |

PRINT CONTROL DEVICE AND PROGRAM

CROSS-REFERENCE TO RELATED APPLICATIONS

The entire disclosure of Japanese Patent Application No. 2012-097841, filed Apr. 23, 2012 is expressly incorporated by reference herein.

BACKGROUND

1. Technical Field

The present invention relates to a print control device and a program.

2. Related Art

A printing apparatus which performs recording by discharging a liquid from nozzles to cause droplets (dots) to land on a medium is known. When printing is performed using such a printing apparatus, there are cases in which density irregularity (for example, white stripes and black stripes) occurs in a printed image, and the quality of the printed image thereby deteriorates.

When such density irregularity occurs, density correction values are acquired for each dot array (raster line), print density for each dot array is corrected based on the acquired density correction values, and the problem of image deterioration caused by the density irregularity can thereby be resolved (BRS correction). In addition, as a method for acquiring such density correction values, there is a method in which a test pattern formed on a medium (a test sheet, or the like) is read using a scanner so as to acquire image data of the test pattern, and density correction values for each dot array are acquired based on the density of pixel arrays corresponding to each of the dot arrays in the acquired image data of the test pattern (for example, JP-A-2005-205691).

In an ink jet printer as a printing apparatus, for example, in order to increase a region in which printing can be performed at one time, a plurality of nozzle arrays are disposed in an arrangement of a nozzle array direction so that the end portions of the nozzle arrays overlap each other. In such an ink jet printer, there are cases in which ink discharge positions of adjacent nozzles are shifted in the overlapping portions of the nozzle arrays due to an alignment error during mounting of nozzles or a difference of ink discharge characteristics of respective nozzles. In such cases, since dot arrays are formed with a shift, the quality of a printed image easily deteriorates. Thus, there is a method for printing while suppressing shifting of formation positions of dot arrays by appropriately moving (shifting) print data allocated to adjacent two nozzles in the nozzle array direction with respect to the position of a predetermined dot array.

However, in the overlapping portions of the nozzle arrays, if the position of a nozzle corresponding to a certain dot array (rater line) is shifted, a density correction value acquired for the position of the dot array is also shifted in the same manner. For this reason, a density correction value suitable for adjacent two nozzles is not applied, and thereby density irregularity is difficult to be sufficiently suppressed.

SUMMARY

An advantage of some aspects of the invention is to perform printing of an image in which a shift of positions of dot arrays is not conspicuous while suppressing density irregularity using a printing apparatus in which portions of a plurality of nozzle arrays are disposed in an overlapping manner.

According to the present invention, there is provided a print control device that controls a printing apparatus including a first nozzle array in which a plurality of nozzles that discharge an ink are lined in a predetermined direction, and a second nozzle array in which a plurality of nozzles that discharge the ink are lined in the predetermined direction and some of the nozzles are disposed in positions overlapping those of some nozzles of the first nozzle array in the predetermined direction, and in the print control device, a plurality of test patterns disposed in the predetermined direction are printed by dot arrays formed along an intersecting direction intersecting with the predetermined direction by using nozzles included in an overlapping portion of the first nozzle array and the second nozzle array, a plurality of rules disposed in the predetermined direction are printed so as to be adjacent to the test patterns by using nozzles included in the first nozzle array and the second nozzle array, density correction values of each of raster lines are computed according to density of each of the raster lines lined in the predetermined direction detected from image data of which the test patterns are read, and the positions of respective nozzles included in the first nozzle array specified from the positions of the rules are associated with the positions of the respective raster lines for which the density correction values are computed and the positions of respective nozzles included in the second nozzle array specified from the positions of the rules are associated with the positions of the respective raster lines for which the density correction values are computed.

Other characteristics of the present invention will be clarified with description of the present specification and accompanying drawings.

BRIEF DESCRIPTION OF THE DRAWINGS

The invention will be described with reference to the accompanying drawings, wherein like numbers reference like elements.

FIG. 12 is an example of a table indicating a corresponding relationship between array region numbers of the extended image data and nozzle numbers of respective heads.

DESCRIPTION OF EXEMPLARY EMBODIMENTS

Figure 1:
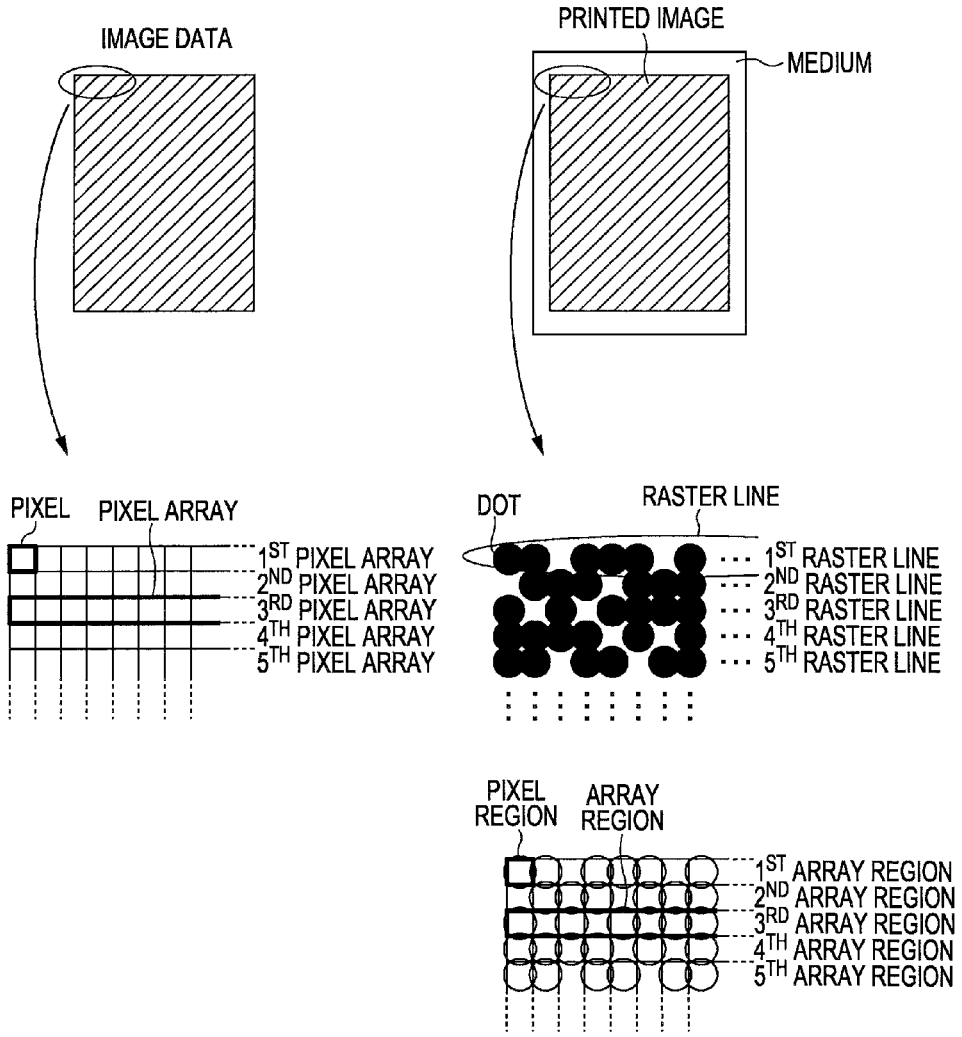
FIG. 1 is a diagram describing the meanings of terms.

Based on description of the present specification and the accompanying drawings, at least the following matters are clarified.

There is provided a print control device that controls a printing apparatus including a first nozzle array in which a plurality of nozzles that discharge an ink are lined in a predetermined direction, and a second nozzle array in which a plurality of nozzles that discharge the ink are lined in the predetermined direction and some of the nozzles are disposed in positions overlapping those of some nozzles of the first nozzle array in the predetermined direction, and in the print control device, a plurality of test patterns disposed in the predetermined direction are printed by dot arrays formed along an intersecting direction intersecting with the predetermined direction by using nozzles included in an overlapping portion of the first nozzle array and the second nozzle array, a plurality of rules disposed in the predetermined direction are printed so as to be adjacent to the test patterns by using nozzles included in the first nozzle array and the second nozzle array, density correction values of each of raster lines are computed according to density of each of the raster lines lined in the predetermined direction detected from image data of which the test patterns are read, and the positions of respective nozzles included in the first nozzle array specified from the positions of the rules are associated with the positions of the respective raster lines for which the density correction values are computed and the positions of respective nozzles included in the second nozzle array specified from the positions of the rules are associated with the positions of the respective raster lines for which the density correction values are computed.

According to the print control device, using the printing apparatus in which some the plurality of nozzle arrays are disposed in an overlapping manner, an image in which a position shift of dot arrays is not conspicuous can be printed while suppressing density irregularity.

In the print control device, it is desirable that the test patterns are printed by adjusting pixel arrays of the image data actually allocated to the respective nozzles so that a shift amount in the predetermined direction between a pixel array on the image data allocated to a nozzle when each nozzle included in the first nozzle array and the second nozzle array is disposed in an ideal position and a pixel array on the image data actually allocated to a nozzle included in the first nozzle array and the second nozzle array is a half or smaller than the distance between two nozzles adjacent to each other in the first nozzle array or the second nozzle array.

According to the print control device, when printing is performed using inks of a plurality of colors, ink discharge from each nozzle can be adjusted so that a color shift or color mixing is difficult to occur. Then, in that state, an appropriate density correction value is easily applied to each nozzle.

In the print control device, it is desirable that, in the overlapping portion of the first nozzle array and the second nozzle array, the positions of the raster lines and the positions of the nozzles are associated with reference to a position in the middle of the position of a rule printed by the first nozzle array and the position of a rule printed by the second nozzle array.

According to the print control device, the relationship between the positions of the rules and the positions of the nozzles of each head that printed the rule is accurately detected with ease. Thus, the relationship between the positions of the raster lines and the positions of the nozzles can be accurately detected based on the rules.

In the print control device, it is desirable that, in the overlapping portion of the first nozzle array and the second nozzle array, the positions of respective nozzles included in the first nozzle array are associated with the positions of the raster lines with reference to the position of a rule printed by the first nozzle array, and the positions of respective nozzles included in the second nozzle array are associated with the positions of the raster lines with reference to the positions of a rule printed by the second nozzle array.

According to the print control device, the relationship between the positions of the rules and the positions of the nozzles of each head that printed the rule is accurately detected with ease. Thus, the relationship between the positions of the raster lines and the positions of the nozzles can be accurately detected based on the rules. In addition, by printing rules individually by each head, the corresponding relationship between the positions of the rules and the positions of the respective nozzles in the overlapping region of the heads is easily clarified.

In the print control device, it is desirable that, in the overlapping portion of the first nozzle array and the second nozzle array, the rules are printed by nozzles included in either nozzle array of the first nozzle array or the second nozzle array.

According to the print control device, the relationship between the positions of the rules and the positions of the nozzles of each head that printed the rule is accurately detected with ease. Thus, the relationship between the positions of the raster lines and the positions of the nozzles can be accurately detected based on the rules. In addition, by printing the rules in the overlapping region of the heads only using the head on one side, the number of rules printed in the overlapping region reduces, and the association of the rules and the nozzles become easy.

In addition, there is provided a program that causes a print control device that controls a printing apparatus including a first nozzle array in which a plurality of nozzles that discharge an ink is lined in a predetermined direction, and a second nozzle array in which a plurality of nozzles that discharge the ink is lined in the predetermined direction and some of the nozzles are disposed in positions overlapping those of some nozzles of the first nozzle array in the predetermined direction to execute a density correction process with functions of printing a plurality of test patterns disposed in the predetermined direction by using dot arrays formed along an intersecting direction intersecting with the predetermined direction using nozzles included in an overlapping portion of the first nozzle array and the second nozzle array, printing a plurality of rules disposed in the predetermined direction are printed so as to be adjacent to the test patterns by using nozzles included in the first nozzle array and the second nozzle array, computing density correction values of each of raster lines according to density of each of the raster lines lined in the predetermined direction detected from image data of which the test patterns are read, and associating the positions of respective nozzles included in the first nozzle array specified from the positions of the rules with the positions of the respective raster lines for which the density correction values are computed, and associating the positions of respective nozzles included in the second nozzle array specified from the positions of the rules with the positions of the respective raster lines for which the density correction values are computed.

Terminology

First, the meanings of terms used in describing the present embodiment will be explained. FIG. 1 is a diagram for describing the terms.

"Image data" is data indicating two-dimensional images. In embodiments to be described later, there are image data of 256 grayscales, image data of 4 grayscales, and the like. When a printer controls formation of dots using 4 grayscales (large dots, medium dots, small dots, and no dots), image data of 4 grayscales indicates a formation state of dots constituting a printed image.

A "printed image" is an image printed on a medium (for example, paper). A printed image of an ink jet printer is constituted by innumerable dots formed on paper.

A "pixel" is a minimum unit constituting an image. An image is constituted by such pixels two-dimensionally arranged. They mostly mean pixels on image data.

A "pixel array" is an array of pixels lined on image data in a predetermined direction. As shown in the drawing, a pixel array being in an $n^{th}$ position is called an "$n^{th}$ pixel array."

A "raster line" is an array of dots lined in a direction in which and paper moves with respect to heads (movement direction). In a case of a line printer as in embodiments described later, a "raster line" means an array of dots lined in the transport direction of paper. On the other hand, in a case of a serial printer that performs printing using heads mounted on a carriage, a "raster line" means an array of dots lined in a movement direction of the carriage. A printed image is formed by a number of raster lines lined in a direction perpendicular to the movement direction. As shown in the drawing, a raster line being in an $n^{th}$ position is called an "$n^{th}$ raster line."

"Image data" is data indicating grayscales of pixels. Image data is constituted by a number of pixel data pieces. There are cases in which "pixel data" is referred to as a "grayscale value of a pixel." In case of image data of 4 grayscales, each pixel data piece is 2-bit data, and indicates a dot formation state (large dots, medium dots, small dots, and no dots) of a pixel.

A "pixel region" is a region on paper corresponding to pixels on image data. For example, when resolution of image data is 180×180 dpi, a "pixel region" is a region of a square shape having one side of 1/180 inches.

An "array region" is a region on paper corresponding to a pixel array. For example, when resolution of image data is 180×180 dpi, an array region is a slit-like region having the width of 1/180 inches. The right lower part of the drawing shows array regions. An "array region" is also a position in which formation of a raster line is aimed. As shown in the drawing, an array region in an $n^{th}$ position is called an "$n^{th}$ array region." The $n^{th}$ array region is a position in which formation of an $n^{th}$ raster line is aimed.

The right lower part of FIG. 1 shows a positional relationship between pixel regions and dots. In this drawing, each of the dots is formed in the pixel regions respectively corresponding thereto. However, there is a case in which dots are not formed in a corresponding pixel region due to being affected by an error in mounting heads, flight deflection of an ink, or the like. Since it is necessary to explain such a circumstance, the present specification explains the meanings and relationships of a "raster line", a "pixel region", and the like along with the above content. However, the meanings of general terms such as "image data" or a "pixel" may be appropriately interpreted based on general technical knowledge, in addition to above explanation.

First Embodiment

Overall Configuration

Figure 2:
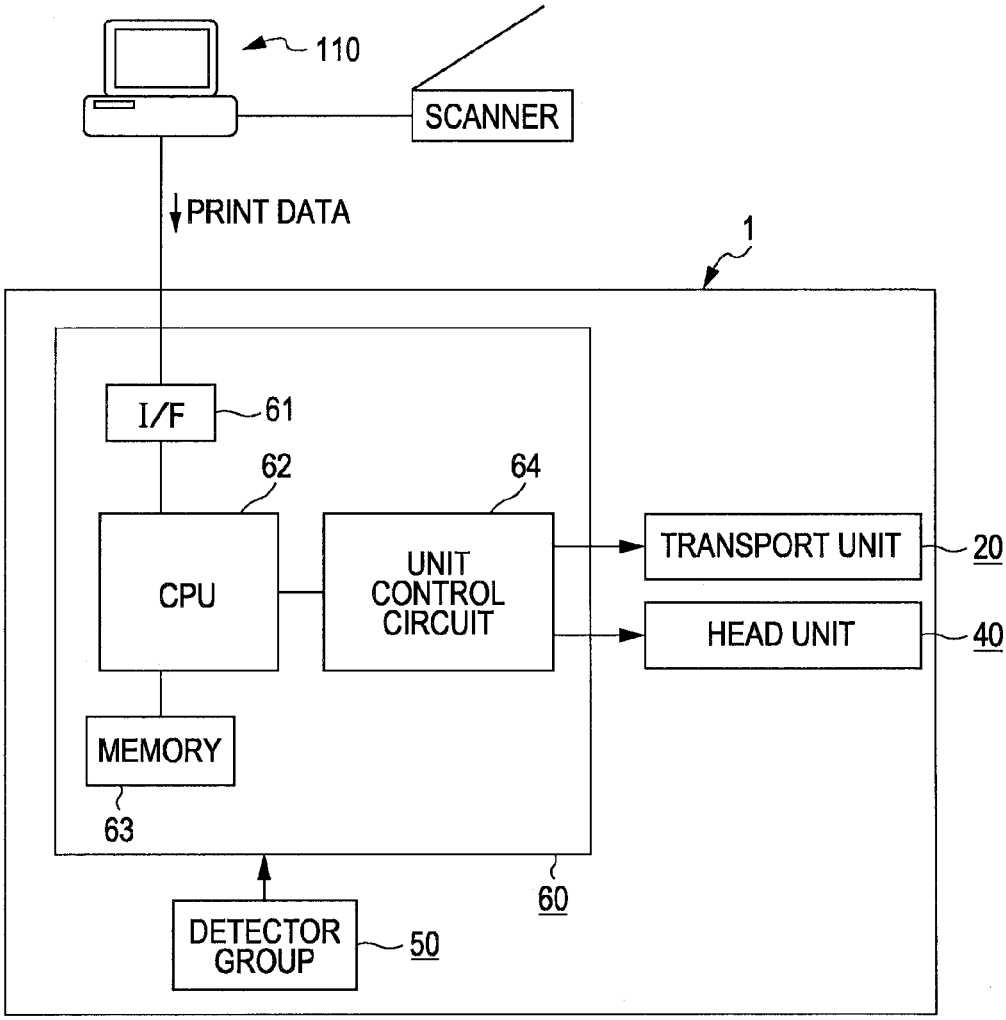
FIG. 2 is a block diagram showing an overall configuration of a printer.
Figure 3:
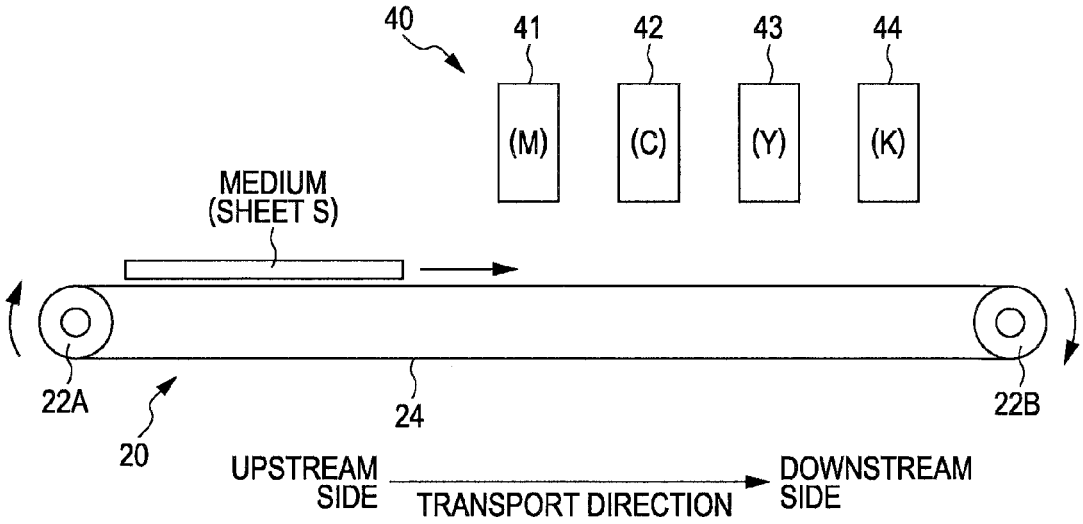
FIG. 3 is a schematic side view of the printer.

In the present embodiment, an image is printed using an ink jet printer (printer 1) as a printing apparatus. FIG. 2 is a block diagram showing an overall configuration of the printer 1. FIG. 3 is a schematic side view of the printer 1.

A computer 110 is connected to the printer 1 and a scanner that is an image reading device if necessary. In the computer 110, a printer driver is installed. The printer driver performs a process causes print data to be generated in the computer 110, transmits this print data to the printer 1 so as to cause the printer 1 to print an image. In other words, in the present embodiment, the computer 110 in which the printer driver is installed is a print control device.

In addition, a scanner driver is installed in the computer 110. The scanner driver can cause the scanner 120 to read a document set in the scanner 120, and thereby acquiring image data from the scanner 120.

The printer 1 has a transport unit 20, a head unit 40, a detector group 50, and a controller 60. The printer 1, which receives print data from the computer 110 that is an external device, controls each unit (the transport unit 20 and the head unit 40) using the controller 60. The controller 60 controls each of the units so as to print an image on a medium such as paper based on the print data received from the computer 110. States inside the printer 1 is monitored by the detector group 50, and the detector group 50 outputs a detection result to the controller 60. The controller 60 controls each of the units based on the detection result output from the detector group 50.

The transport unit 20 transports the medium (for example, paper S, or the like) in a predetermined direction (hereinafter, referred to as a transport direction). This transport unit 20 has an upstream-side roller 22A, a downstream-side roller 22B, and a belt 24. When a transport motor not shown in the drawing rotates, the upstream-side roller 22A and the downstream-side roller 22B rotate, and the belt 24 thereby rotates. The fed medium (for example, the paper S) is transported to a printable region (a region facing the head unit 40) by the belt 24, and then an image is printed when the medium passes the region. The paper S that has passed the printable region is discharged to outside by the belt 24. Note that the paper S being transported is electrostatic-attracted or vacuum-attracted by the belt 24.

The head unit 40 is for discharging inks on the paper S, and forms droplets (dots) of inks on the paper S by discharging inks from nozzles on the paper S being transported so as to print an image. The head unit 40 has 4 heads including heads 41 to 44 along the transport direction. A magenta nozzle array (M) that discharges a magenta ink is provided in the head 41. A cyan nozzle array (C) that discharges a cyan ink is provided in the head 42. A yellow nozzle array (Y) that discharges a yellow ink is provided in the head 43. A black nozzle array (B) that discharges a black ink is provided in the head 44. The printer 1 of the present embodiment is a color printer, and the head unit 40 can form dots in the width of the medium (paper S) in one time.

A specific configuration of the head unit 40 will be described later.

A rotary encoder (not shown) that detects a rotation amount of the upstream-side roller 22A (or the downstream-side roller 22B), and the like are included in the detector group 50. Based on a detection result of the rotary encoder, a transport amount of the paper S can be detected.

The controller 60 is a control unit (control part) for controlling the printer 1. The controller 60 has an interface unit 61, a CPU 62, a memory 63, and a unit control circuit 64. The CPU 62 is an arithmetic processing device for controlling the entire printer. The memory 63 is for securing an area in which programs are stored or a work area of the CPU 62, or the like, and has a storage element such as a RAM, EEPROM, or the like. The CPU 62 controls each unit via the unit control circuit 64 according to programs stored in the memory 63.

Configuration of Head Unit 40

Figure 4:
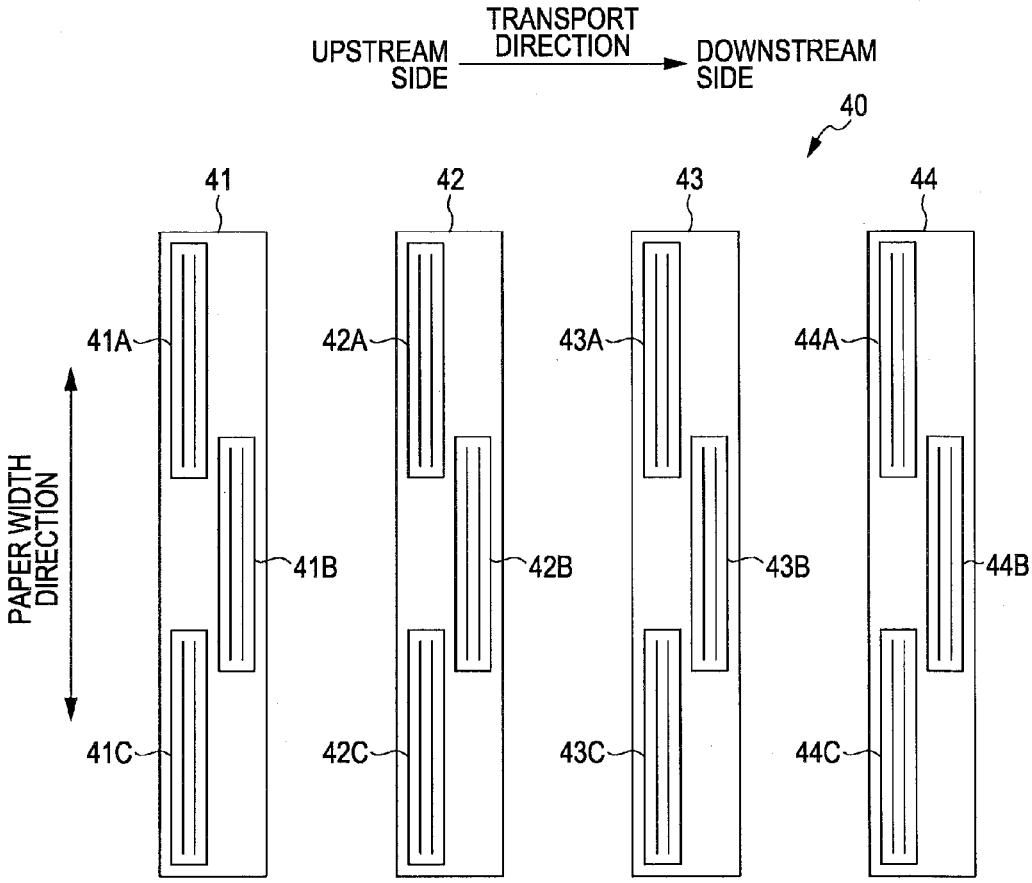
FIG. 4 is an illustrative diagram of an arrangement of a plurality of heads on a bottom face of a head unit.

FIG. 4 is an illustrative diagram of an arrangement of the plurality of heads on a bottom face of the head unit 40. The head unit 40 has the heads 41 to 44. The heads 41 to 44 respectively have a plurality of end heads. For example, the head 41 has short heads 41A and 41C on the upstream side in the transport direction and the head 41B on the downstream side in the transport direction. The short head 41B is disposed so as to be positioned between the short heads 41A and 41C in the paper-width direction. In other words, the head 41 is configured to have a plurality of short heads disposed in a zigzag shape along the paper-width direction. Hereinafter, the "short heads 41A, 41B, and 41C" will be simply called "heads 41A, 41B, and 41C." Note that, in FIG. 3, one head is constituted by three short heads, but the number of short heads may be arbitrarily set, and 4 or more short heads may be provided in one head.

The configurations of the heads 42 to 44 are substantially the same as that of the head 41 (see FIG. 4).

Figure 5:
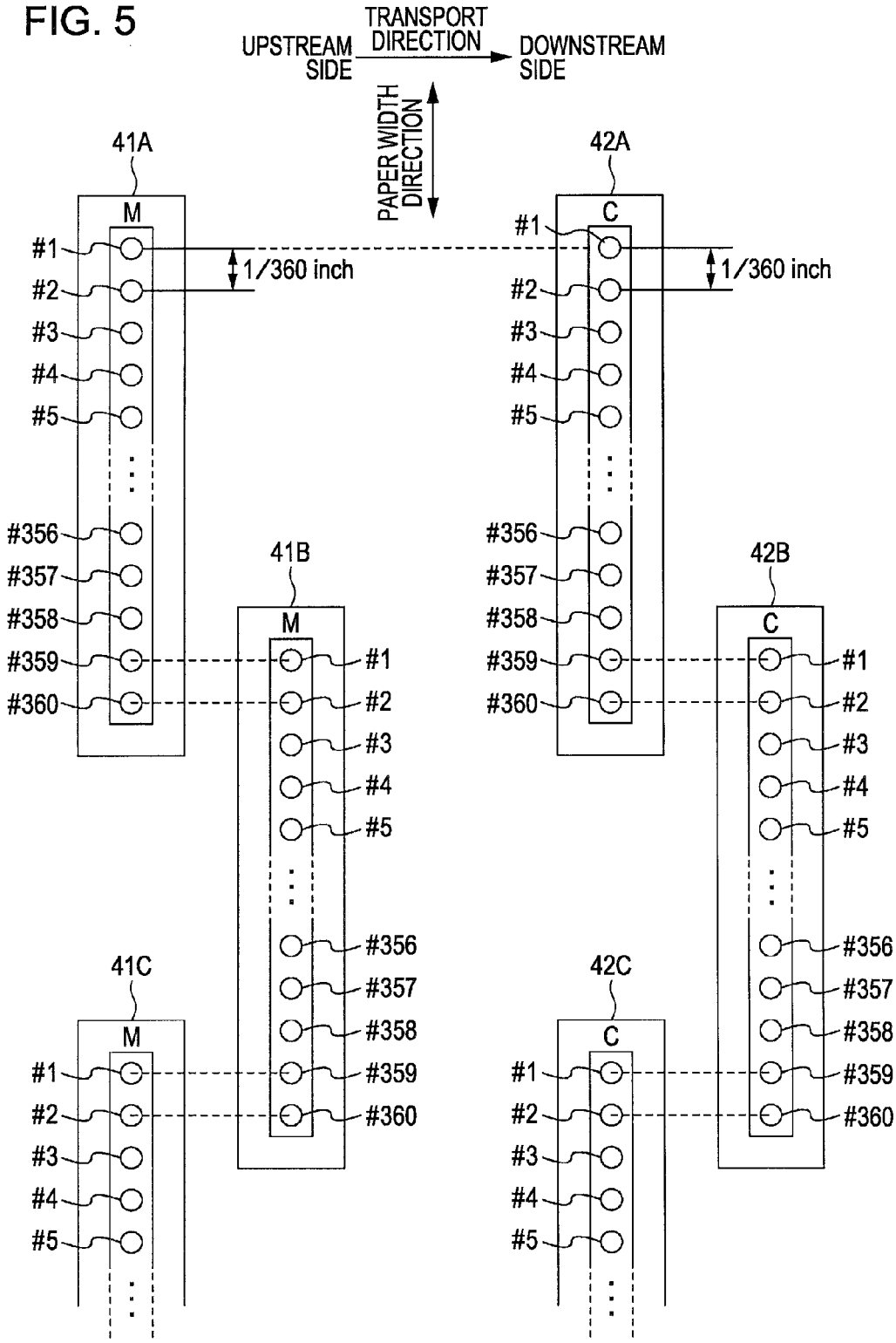
FIG. 5 is an illustrative diagram of the disposition of nozzles in each head.

FIG. 5 is an illustrative diagram of the disposition of nozzles in each head. In each head (short head), a nozzle array constituted by a plurality of nozzles is lined along the paper-width direction. For the convenience of description, FIG. 5 shows an example in which each one nozzle array is provided in each head (short head), but the number of nozzle arrays provided in each nozzle may be two or higher. In addition, description is provided with respect to FIG. 5 exemplifying the heads 41 and 42, but the heads 43 and 44 also have substantially the same configuration.

The short heads 41A to 41C of the head 41 respectively have a magenta (M) nozzle array that discharges the magenta ink, the short heads 42A to 42C of the head 42 respectively have a cyan (C) nozzle array that discharges the cyan ink. Each nozzle array has 360 nozzles discharging inks. The 360 nozzles of each nozzle array are lined with a predetermined nozzle pitch (for example, 1/360 inches) along the paper-width direction. In description below, the 360 nozzles of each nozzle array will be called a nozzle #1, a nozzle #2, . . . , a nozzle #360 in order from above in the drawing. Note that the number of nozzles provided in each nozzle array is not limited to 360.

In each of the nozzles, piezoelectric elements (driving elements) such as piezo element (not shown) are provided. When a voltage waveform signal having a size according to pixel data (4 grayscales) is applied to the piezoelectric elements, the piezoelectric elements are extended or contracted for driving according to the size of a voltage, and a predetermined amount of inks is thereby discharged from the nozzle unit.

The nozzles #359 and #360 of the head 41A are disposed so as to line with the nozzles #1 and #2 of the head 41B respectively in the transport direction. In the same manner, the nozzles #359 and #360 of the head 41B are disposed so as to line with the nozzles #1 and #2 of the head 41C in the transport direction. In other words, two nozzles of two short heads (for example, the head 41A and the head 41B) adjacent in the paper-width direction are disposed in positions overlapping in the paper-width direction. By disposing the nozzles in an overlapping manner as above, joints of heads on a printed image can be set not to be conspicuous.

In addition, the head 41 and the head 42 are disposed in corresponding positions in the transport direction. For example, the magenta (M) nozzle #1 of the head 41A and the cyan (C) nozzle #1 of the head 42A are in positions overlapping in the paper-width direction, and disposed in positions shifted with respect to the transport direction. In addition, the magenta (M) nozzle #1 of the head 41B and the cyan (C) nozzle #1 of the head 42B are in positions overlapping in the paper-width direction, and disposed in positions shifted with respect to the transport direction.

Regarding Formation of Dot Array

Formation of a dot array using the printer 1 will be described. Herein, description will be provided on the assumption that each head is mounted in a position as designed, and dots are formed in an ideal state. Note that formation of dots by the magenta (M) nozzle arrays of the head 41 will be described, but the same is applied also to formation of dots by nozzle arrays of other colors.

Figure 6:
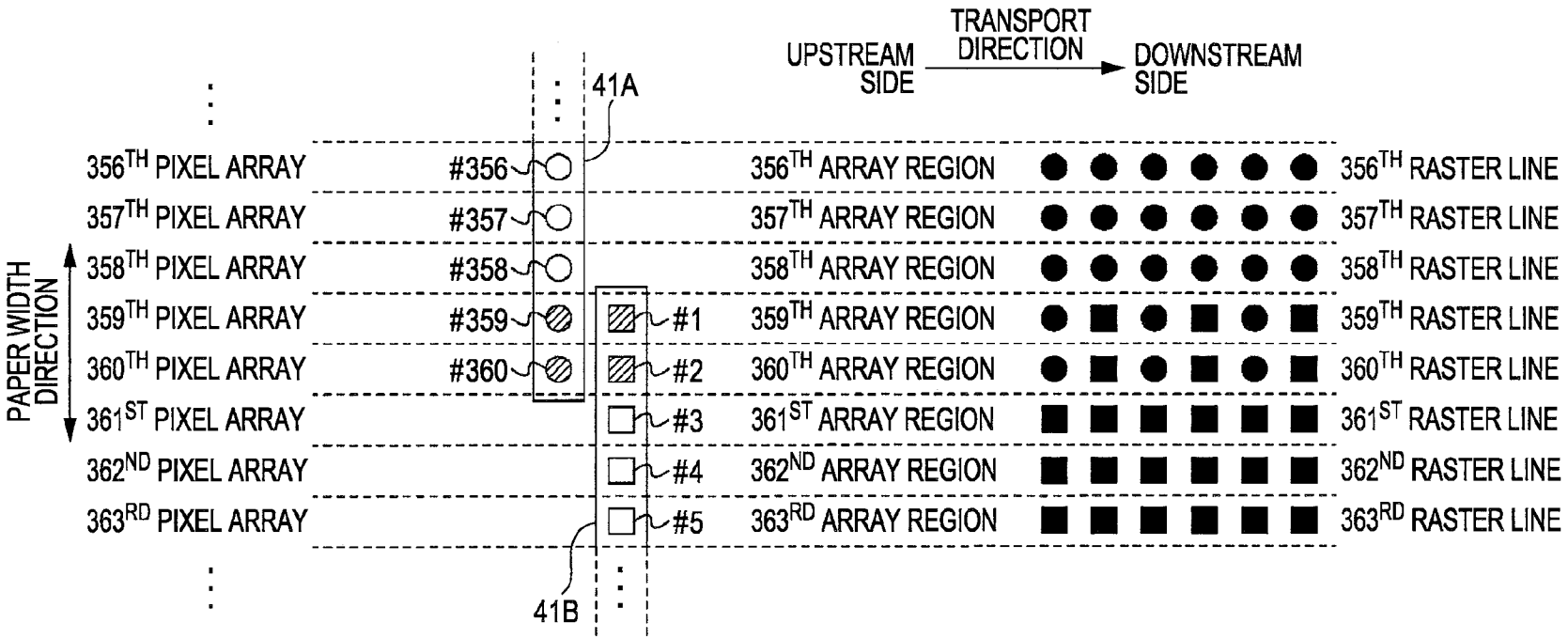
FIG. 6 is an illustrative diagram of the appearance of dot formation.

FIG. 6 is an illustrative diagram of the appearance of dot formation. In the drawing, the nozzles of the head 41A are indicated by circles, and the nozzles of the head 41B are indicated by squares. Note that hatching is performed for nozzles overlapping in the paper-width direction (the nozzles #359 and #360 of the head 41A, and the nozzles #1 and #2 of the head 41B). On the right side of the drawing, dots formed by the nozzles of the head 41A are indicated by black circles, and dots formed by the nozzles of the head 41B are indicated by black squares.

As shown in FIG. 6, $356^{th}$ to $358^{th}$ pixel arrays are respectively associated with nozzles #356 to #358 of the head 41A, and raster lines indicated by black circles are formed according to respective pixel data pieces. In the same manner, $361^{st}$ to $363^{rd}$ pixel arrays are respectively associated with nozzles #3 to #5 of the head 41B, and raster lines indicated by black squares are formed.

On the other hand, in a $359^{th}$ pixel array, two nozzles of the nozzle #359 of the head 41A and the nozzle #1 of the head 41B are associated with each other. Herein, odd-numbered pixel data pieces (black circles in the drawing) of the $359^{th}$ pixel array are associated with the nozzle #359 of the head 41A, and even-numbered pixel data pieces (black squares in the drawing) are associated with the nozzle #1 of the head 41B. Then, inks are discharged from each nozzle according to the pixel data. When dots are formed in an ideal state, dots are formed at intervals of one dot by the nozzle #359 of the head 41A, and in order to interpolate the space between dots, dots are formed at intervals of one dot by the nozzle #1 of the head 41B. Accordingly, a $359^{th}$ raster line is formed by the two nozzles in the $359^{th}$ array region. Note that formation of dots in a $360^{th}$ array region is the same.

Hereinafter, nozzles in an overlapping region of dot arrays (for example, the nozzle #359 of the head 41A and the nozzle #1 of the head 41B) are called "overlapping nozzles." In FIG. 6, the "overlapping nozzles" are the nozzles with hatching.

Formation of Dots in a State with Head Mounting Error

A case in which dots are formed in an ideal state will be described, but since an error is made in mounting a head in a rotation direction or a translation direction (a direction parallel with the paper-width direction) in reality, there is a case in which dot arrays are not formed in an ideal state. In addition, there are cases in which dots arrays are not formed in an ideal state due to transporting of paper in an inclined or serpentine manner, or discharging of inks from nozzles in a curved manner. Herein, a case in which there is a mounting error is described.

Figure 7:
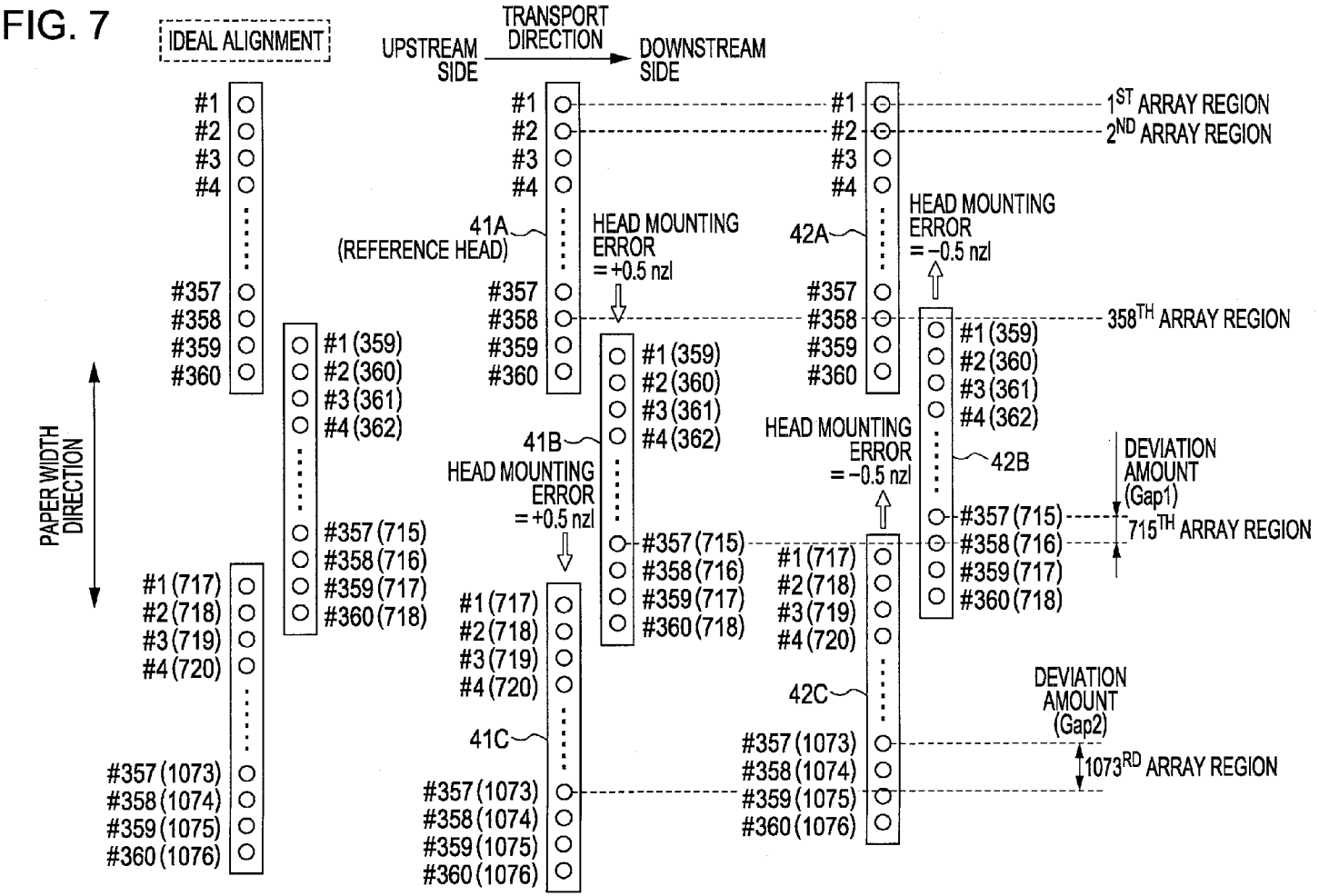
FIG. 7 is a diagram describing a case in which formation positions of dots are shifted between arrays of two different color nozzles.

FIG. 7 is a diagram describing a case in which formation positions of dots are shifted between nozzle arrays of two different color nozzles. The # given to each nozzle indicates a nozzle number, and a number in the parenthesis after # indicates the number of the array region in which the nozzle is in charge. The heads (nozzle arrays) on the left side of FIG. 7 indicates the positions of each nozzle array in an ideal state in which there is no error in mounting the heads when the head 41A is a reference head (hereinafter, referred to as an ideal alignment). In addition, the head (nozzle array) shown on the right side of the ideal alignment is an example of actual disposition of the nozzle array, in other words, the position of the nozzle array in the paper-width direction is shifted with respect to the ideal alignment.

When a blue rule is printed along the transport direction in a array region, printing is performed by discharging magenta (M) and cyan (C) inks from nozzles in the same position in the paper-width direction. When, for example, in FIG. 7, a blue rule is desired to be printed in the $358^{th}$ array region, a magenta (M) ink is discharged from the nozzle #358 of the head 41A, and a cyan (C) ink is discharged from the nozzle #358 of the head 42A. Herein, the nozzle #358 of the nozzle 41A and the nozzle #358 of the head 42A are in the positions overlapping in the paper-width direction (there is no shift in the paper-width direction), the inks are discharged respectively from the two nozzles, and the blue rule as instructed in print data is thereby printed in the $358^{th}$ array region.

Next, when a blue rule is printed in a $715^{th}$ array region in the same manner, inks are discharged respectively from a nozzle #357 of the head 41B and a nozzle #357 of the head 42B. However, as shown in FIG. 7, when a mounting error of +0.5 nozzle is made in the head 41B in the paper-width direction and a mounting error of −0.5 nozzle is made in the head 42B in the paper-width direction, a shift of one nozzle is made between the two nozzles in the paper-width direction. As a result, as shown in FIG. 7, a shift amount of about one nozzle (this shift amount is indicated by Gap 1) in the $715^{th}$ array region is generated. In this case, due to shifted landing positions of dots of the magenta ink discharged from the head 41B and dots of the cyan ink discharged from the head 42B, a printed line has a color of which the hue is different from blue as instructed in the print data. After all, color shift, or the like occurs.

Note that a "shift amount of one nozzle" refers to a shift amount as far as the gap between two adjacent nozzles (for example, the nozzle #1 and the nozzle #2 of the head 41A) in each nozzle array in the paper-width direction.

Next, when a blue rule is printed in a $1073^{rd}$ array region in the same manner, an ink is discharged respectively from the nozzle #357 of the head 41C and the nozzle #357 of the head 42C. However, when a mounting error of +0.5 nozzle is made in the head 41C in the paper-width direction and a mounting error of −0.5 nozzle is made in the head 42C in the paper-width direction, a shift amount of the head 41C and the head 42C in the paper-width direction further increases due to an accumulated shift amount of the head 41B and the head 42B. In FIG. 7, a shift amount of the nozzle #357 of the head 41C and the nozzle #357 of the head 42C in the paper-width direction (this shift amount is indicated by Gap 2) is about two nozzles. The shift amount further increases due to the fact that Gap 2>Gap 1, and even when one blue rule is printed, it looks as if two rules, which are a magenta (M) rule and a cyan (C) rule, are printed in reality. In addition, there is concern that color mixing, or the like occurs due to mixing with ink dots of other colors.

In this manner, when positions of color ink nozzles in the paper-width direction are shifted due to the positions being affected by an error of mounting positions of heads in the paper-width direction, a position in which dots are formed (array region) is shifted, and problems such as color shift and color mixing are generated according to the magnitude of the shift amount.

Color Shift Correction Process

Figure 8:
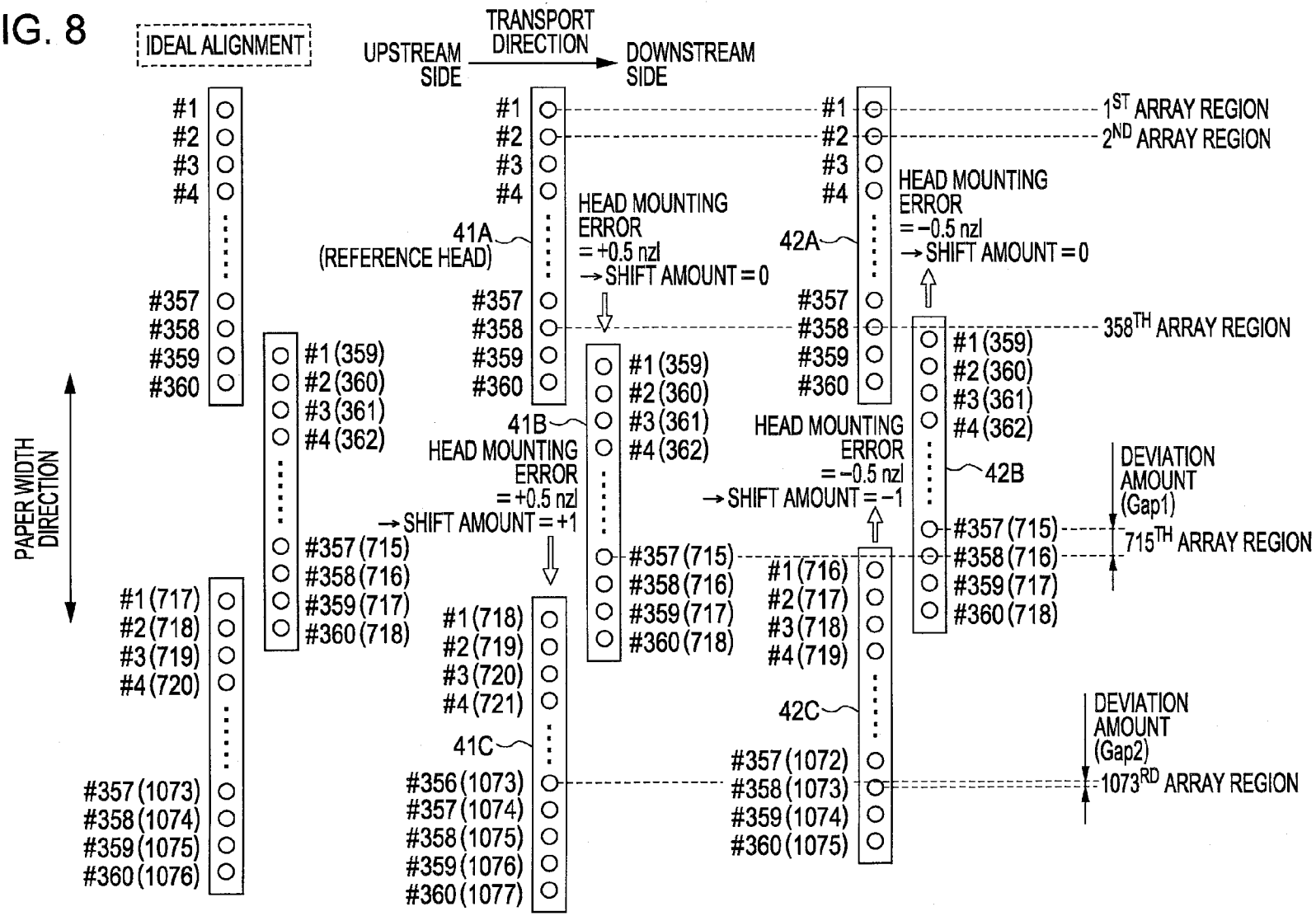
FIG. 8 is an illustrative diagram of the appearance of dot formation when a process of overlapping nozzles with reference to positions (arrays) in which ink dots are landed is performed.

A correction process for suppressing color shift and color mixing (hereinafter, referred also to a process of "array reference") will be described focusing on shift of landing positions of color ink dots in each array region as described above. FIG. 8 is an illustrative diagram of the appearance of dot formation when a process of overlapping nozzles with reference to positions (arrays) in which ink dots are landed is performed in the present embodiment.

In the array reference process, a reference head (the head 41 in FIG. 8) is set, and an ideal alignment obtained from the reference head (the head positions at the left end of FIG. 8) is computed. Then, with respect to a pixel array allocated to each nozzle in the ideal alignment, the pixel array allocated to each nozzle is moved (shifted) so that an actual error mount of the pixel array allocated to the nozzle in the mounted heads becomes 0.5 nozzle or smaller.

In FIG. 8, the magenta (M) nozzle array of the head 41B has a shift amount of about +0.5 nozzle (herein, set to be 0.5 nozzle or smaller) with respect to the ideal alignment in the paper-width direction. When the shift amount is 0.5 nozzle or smaller, the position of the pixel array allocated to each nozzle of the head 41B is not shifted, and the shift amount becomes 0. In addition, the magenta (M) nozzle array of the head 41C has a shift amount of about +0.5 nozzle with respect to the head 41B in the paper-width direction. Since the shift amounts accumulate, the magenta (M) nozzle array of the head 41C has a shift amount in the range of being equal to or greater than +0.5 nozzle and equal to or smaller than +1.5 nozzle with respect to the ideal alignment in the paper-width direction. In this case, the pixel array allocated to each nozzle is shifted so that the shift amount becomes equal to or smaller than 0.5 nozzle. For example, in FIG. 8, the pixel array allocated to the head 41C is shifted by one array on the plus side, and the shift amount becomes +1. As a result, the pixel array of which the nozzle #1 of the head 41C is in charge is changed from a $717^{th}$ pixel array to a $718^{th}$ pixel array.

The head 42 is considered in the same manner. When the cyan (C) nozzle array of the head 42B has a shift amount that is equal to or smaller than −0.5 nozzle with respect to the ideal alignment in the paper-width direction, the shift amount is equal to or smaller than 0.5 nozzle, and thus, the pixel array allocated to each nozzle of the head 42B is not shifted, and the shift amount becomes 0. In addition, the cyan (C) nozzle array of the head 42C has a shift amount of −0.5 nozzle with respect to the head 42B in the paper-width direction. Since the shift amounts accumulate, the cyan (C) nozzle array of the head 42C has a shift amount in the range from −0.5 nozzle to −1.5 nozzle with respect to the ideal alignment in the paper-width direction. Thus, the pixel array allocated to the head 42C is shifted by one array on the minus side, and the shift amount becomes −1. As a result, the pixel array of which the nozzle #1 of the head 42C is in charge is changed from the 717$^{th}$ pixel array to a 716$^{th}$ pixel array.

By shifting the pixel array allocated to each nozzle using the array reference, a color error between arbitrary two colors can be one raster to the maximum, and a shift amount between nozzles to which the same array region is allocated in a joint of heads can be suppressed to be smaller than one raster.

For example, a shift amount of about two nozzles is generated as Gap 2 for the 1073$^{rd}$ array region in FIG. 7. However, in FIG. 8, the pixel array allocated to the magenta (M) nozzle array of the head 41C is shifted by +1, and the 1073$^{rd}$ array region is thereby allocated to the nozzle #356, and the pixel array allocated to the cyan (C) nozzle array of the head 42C is shifted by −1, and the 1073$^{rd}$ array region is thereby allocated to the nozzle #358. Accordingly, the shift amount between the magenta (M) nozzle array and the cyan (C) nozzle array (Gap 2) in the 1073$^{rd}$ array region is 0 nozzle. In addition, the shift amount between the magenta (M) nozzle array and the cyan (C) nozzle array (Gap 1) in the 715$^{th}$ array region is about 1 nozzle, and therefore, the shift amount between respective nozzles is within one raster in both cases.

By changing (adjusting) setting of a pixel array allocated to each nozzle in this manner, a shift of landing positions of color ink dots in the paper-width direction can be reduced, and occurrence of color shift and color mixing can be suppressed. Note that an algorithm for pixel array allocation for solving the color shift and color mixing is not limited only to the method, and may be implemented in other methods. In addition, in the above-described example, setting of an ideal alignment with respect to the position of the head 41A has been described, but the setting may be made with respect to the position of another head (nozzle array).

Problem in Density Correction

While color shift, or the like can be effectively solved when a pixel array allocated to each nozzle with the array reference as described above is shifted, a problem occurs when density correction (BRS) for each array region is performed. Note that, since details of density correction (BRS) are described in JP-A-2005-205691, the description is omitted herein.

In density correction (BRS) of the related art, density correction values (BRS correction values) are computed for each of array regions, the computed BRS correction values are applied respectively to nozzles that are in charge of the array regions so as to adjust amounts of inks discharged from the nozzles, and density of each raster line is corrected. In this case, a shift of a pixel array as described above is not considered in the array regions to which the BRS correction values are applied. When there is no shift in a nozzle position, for example, in FIG. 5, the BRS correction value for cyan (C) of a 718$^{th}$ array region is supposed to be allocated to the nozzle #360 of the head 42B and the nozzle #2 of the head 42C.

With regard to this matter, even when nozzles are shifted based on the array reference as in FIG. 8, the BRS correction value for cyan (C) of a 718$^{th}$ array region is allocated to the nozzle #360 of the head 42B and the nozzle #2 of the head 42C. In other words, the same BRS correction value is allocated to two nozzles in positions shifted in the paper-width direction (nozzle array direction).

For example, it is assumed that the BRS correction value for cyan (C) of a 718$^{th}$ array region is a correction value that increases density by 10% (expressed as +10%), and the BRS correction value for cyan (C) of 717$^{th}$ and 719$^{th}$ array regions is a correction value that does not change density (expressed as ±0%). In this case, the correction value allocated for the nozzle #360 of the head 42B and the nozzle #2 of the head 42C is +10%. In addition, the correction value of ±0% is allocated to the nozzle #3 of the head 42C that is an overlapping nozzle corresponding to the nozzle #360 of the head 42B, and the correction value of ±0% is allocated to the nozzle #359 of the head 42B that is an overlapping nozzle corresponding to the nozzle #2 of the head 42C. In this case, in the 717$^{th}$ array region after the array reference shift (the nozzle #359 of the head 42B and the nozzle #2 of the head 42C in FIG. 8), an ink with density of +10% is discharged from the nozzle #2 of the head 42C, and thus, the 717$^{th}$ array region that does not originally need a density correction value is printed in high density. In addition, in the 718$^{th}$ array region after the array reference shift (the nozzle #360 of the head 41B and the nozzle #3 of the head 42B), density of the nozzle #3 of the head 42B is ±0%, and thus, the 718$^{th}$ array region that originally needs density correction of +10% is printed in low density.

In this manner, density correction is not appropriately performed in an overlapping nozzle, and quality of a printed image thereby deteriorates.

Overview of Present Embodiment

Therefore, in the present embodiment, an appropriate density correction value is applied to each nozzle while shifting print data so as not to cause color shift, or the like in an overlapping portion of nozzle arrays (overlapping region). For example, in the case of FIG. 8 described above, adjustment is performed by a printer driver so that a density correction value (BRS correction value) that is supposed to be applied to the 718$^{th}$ array region is allocated to corresponding overlapping nozzles (in this case, the nozzle #360 of the head 42B and the nozzle #3 of the head 42C).

First, the number (x) of an array region in image data of an image to be printed is associated with the number (#i) of a nozzle provided in each head. Then, a BRS correction pattern is printed, a correction value for each raster line is computed from the correction pattern, and the number (k) of a raster line for which the correction value is computed is associated with the nozzle number (#i) of each head. Then, image data of which density is corrected for each array region (x) is generated using the number (k) of a raster line associated with a shared nozzle number (#i) and the correction value. By performing printing using the image data after the correction, an image having satisfactory quality in which position shift of dot arrays is not conspicuous can be printed while suppressing density irregularity.

Density Correction Process

Figure 9:
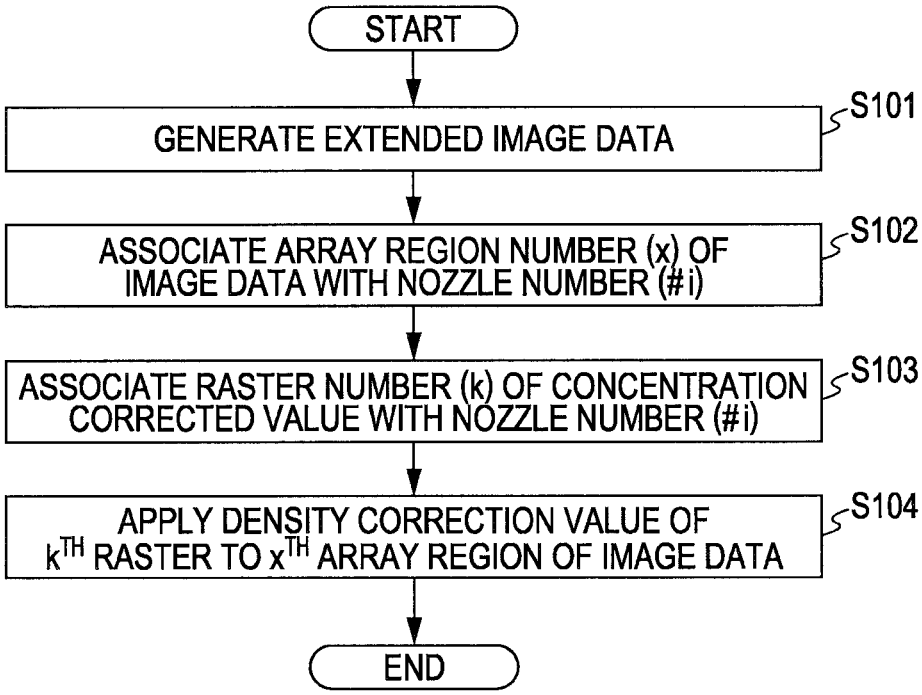
FIG. 9 is a flowchart of a density correction process.

FIG. 9 shows a flowchart of a density correction process performed in the present embodiment. In the present embodiment, density correction of image data is performed by the printer driver sequentially executing processes of S101 to S104.

S101: Extended Image Data Generation

Figure 10:
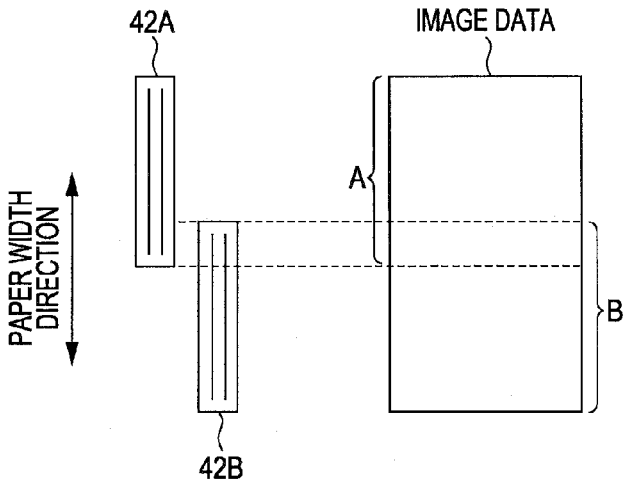
FIG. 10 is a diagram describing generation of extended image data.

First, data of an image (image data) to be printed is copied and extended to generate extended image data. FIG. 10 is a diagram describing the generation of the extended image data. The diagram shows image data in the range formed by the head 42A and the head 42B. With regard to the image data as shown in the drawing, the printer driver generates extended image data by copying and extending the original image data in the region formed by the head 42A (the portion indicated by A in the drawing) and the region formed by the head 42B (the portion indicated by B in the drawing).

S102: Association of Array Region Number (x) of Image Data and Nozzle Number (#i)

Figure 11:
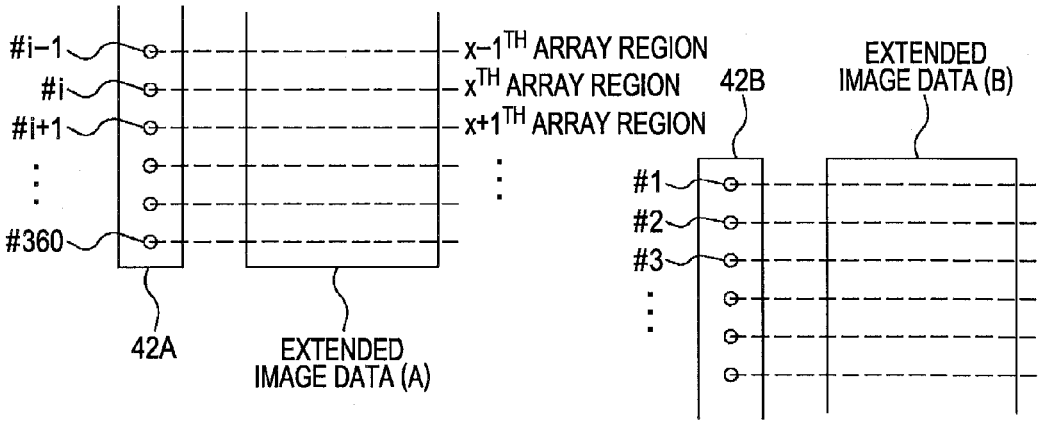
FIG. 11 is a diagram describing a corresponding relationship between array regions in the extended image data and respective nozzles.

Based on the extended image data generated in S101, an x$^{th}$ array region of the extended image data is associated with a nozzle #i. FIG. 11 is a diagram describing a corresponding relationship between array regions in the extended image data and respective nozzles. Note that, for the sake of convenience of description, FIG. 11 only shows the nozzle arrays for cyan (C).

An ink is discharged from the nozzle #i of the head 42A to the $x^{th}$ array region in extended image data (A) of the drawing. Thus, the nozzle #i of the head 42A is associated with the $x^{th}$ array region. In the same manner, the nozzle #i−1 of the head 42A is associated with the $x-1^{th}$ array region, and the nozzle #i+1 of the head 42A is associated with the $x+1^{th}$ array region. The nozzles of the head 42A and the array regions of the extended image data (A) are associated with each other.

In addition, each of array regions of extended image data (B) is associated with each of nozzles of the head 42B in the same manner.

FIG. 12 is an example of a table indicating a corresponding relationship between array region numbers of the extended image data and nozzle numbers of the respective heads associated in S102. As in the table, with regard to the array region numbers of image data, head numbers and nozzle numbers are associated. For example, the nozzle associated with the $x^{th}$ array region is the nozzle #i of the head 42A as described above. The printer driver generates such a table equivalent to that of FIG. 12 for each ink of MCYK (in other words, for each nozzle array discharging each color ink), and causes it to be stored in a storage medium such as the memory 63, or the like. Association of raster lines that are targets of density correction of a printed image and nozzles that are in charge of the raster lines becomes easy.

S103: Association of Rater Number (k) of Density Correction Value and Nozzle Number (#i)

Next, density correction values are obtained for each raster line of the printed image, and a density correction value obtained for a $k^{th}$ raster line is associated with the nozzle #i of each head.

Figure 13:
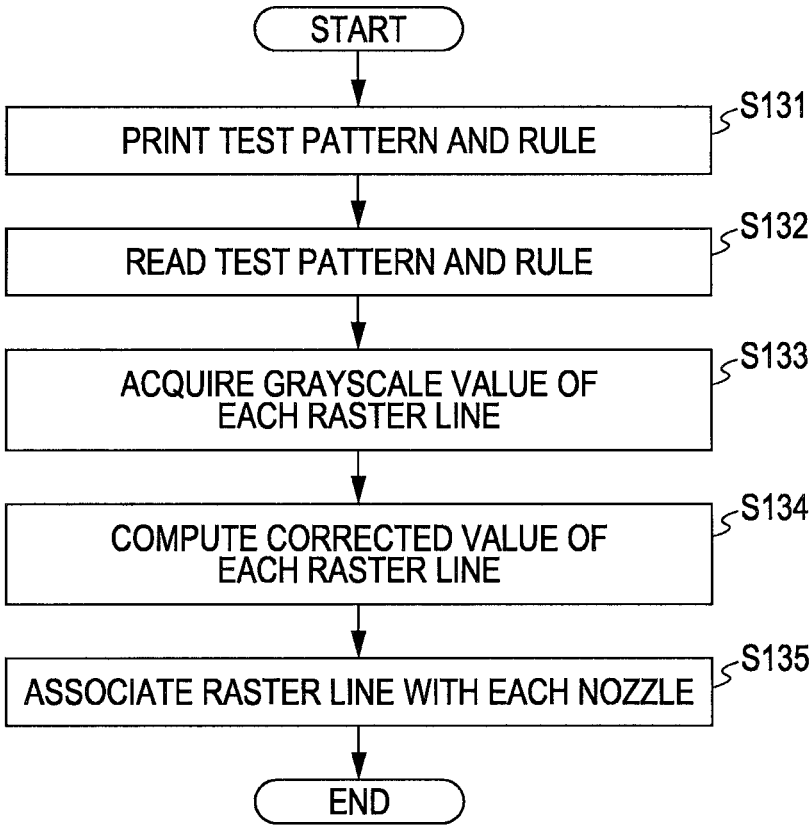
FIG. 13 is a flowchart of a case in which density correction values obtained for each raster line of an image are associated with respective nozzles.

FIG. 13 is a flowchart of a case in which density correction values obtained for each raster line of an image are associated with respective nozzles. Note that, hereinbelow, an example in which, using cyan (C) nozzle arrays of the head 42A and 42B, density correction values (BRS correction values) for each raster line are obtained for cyan and associated with each of nozzles in the cyan (C) nozzle arrays will be described. A basic operation for cyan (C) is the same for each nozzle arrays (of MYK).

Figure 14:
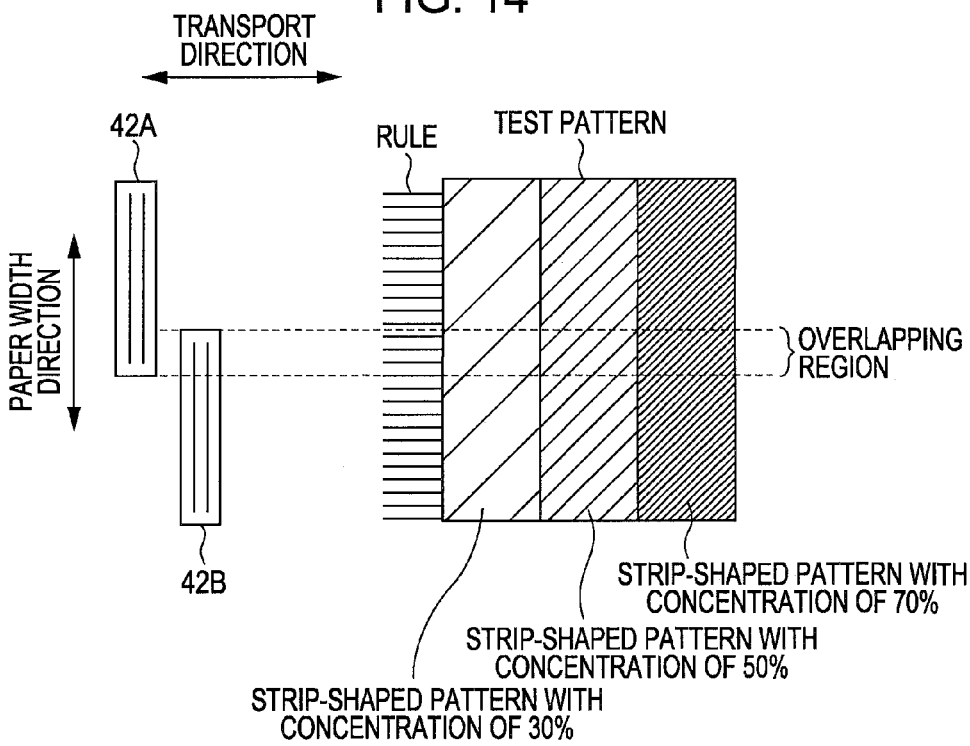
FIG. 14 is a diagram showing an example of a test pattern.

First, printing of test patterns and rules is performed (S131). FIG. 14 shows an example of test patterns used in the present embodiment. In the present embodiment, the strip-shaped test patterns indicated as a shaded portion of the drawing and a plurality of rules adjacent to the left side (or the right side) of the strip-shaped test patterns are printed.

The test patterns are printed by the head 42A and the head 42B, and includes, for example, three regions having density of 30%, 50%, and 70%. The test patterns are formed in such way that a plurality of dot arrays along the transport direction are lined in the paper-width direction, and when density irregularity occurs in a certain array region, a shift is caused in a raster line corresponding to the array region along the transport direction of the test patterns. Thus, by obtaining a correction value for correcting density of the raster line in which a shift is caused (in other words, a position in the paper-width direction in which a shift is caused), occurrence of density irregularity in a printed image can be suppressed. In the present embodiment, the strip-shaped pattern is printed based on the "array reference" described above, causing color shift, or the like to be difficult to occur.

In addition, the plurality of rules to be printed adjacent to the strip-shaped pattern are printed so as to be lined in the paper-width direction using predetermined nozzles of the head 42A and the head 42B. For example, the nozzles such as the nozzle #1, the nozzle #10, the nozzle #20, . . . of the head 42A are selected for printing so that intervals of the rules are substantially equal. After all, the number of nozzles used in printing the rules are obvious in the present embodiment.

Herein, when the rules are printed, print data is adjusted so that the distance in the paper-width direction (nozzle array direction) between the nozzle #i of the head 42A and the nozzle of the head 42B in the position in the transport direction corresponding to the nozzle #i is 0.5 nozzle or shorter. In other words, a shift amount in the nozzle array direction of nozzles of the head 42A and the head 42B in the overlapping range (overlapping nozzles) is 0.5 raster or smaller. When a shift occurs in the overlapping nozzles as described above, the rule printed by the nozzle #i of the head 42A and the rule printed by the nozzle of the head 42B corresponding to the nozzle #i are printed in shifted positions.

The printed test patterns and rules are read using an image reading device such as a scanner, and acquires as image data (S132). As a scanner, a general image scanner can be used. Then, grayscale values (density) for each raster line are measured based on the acquired image data (S133), and density correction values (BRS correction values) for each raster line are computed based on the grayscale values (density) (S134). Note that, since density correction value (BRS correction value) computing means of S132 to S134 is known, detailed description thereof will be omitted.

Next, the correction values computed for each raster line are associated with respective nozzles of each head (S135). As shown in FIG. 14, the rules are printed adjacent to the test pastern in the present embodiment. With reference to the rules, the positions of the raster lines for which the density correction values are computed and the positions of respective nozzles are associated.

Figure 15:
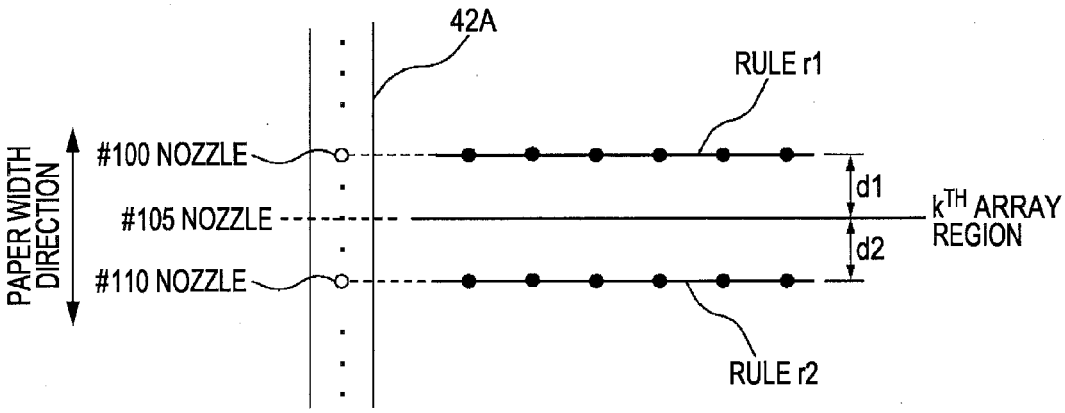
FIG. 15 is a diagram describing association of each raster number of each density correction value with each nozzle number when a rule is printed by one head (one nozzle).

FIG. 15 is a diagram describing association of each raster number of each density correction value with each nozzle number when a rule is printed by one head (one nozzle). In the present embodiment, the case in which a rule is printed by one nozzle means that a rule is printed using a nozzle in a region other than a head overlapping region. It is assumed in S134 that a density correction value Ck is computed for a $k^{th}$ raster line (raster number=k) of the test patterns. First, the printer driver selects two rules (rules r1 and r2 in the drawing) located in the upper and lower portions of the $k^{th}$ raster line in the paper-width direction. Since the nozzle used in printing the rule r1 and the nozzle used in printing the rule r2 are obvious as described above, nozzle numbers corresponding to the positions of the nozzles are specified. It is assumed in FIG. 15 that the rule r1 is formed by the nozzle #100 of the head 42A, and the rule r2 is formed by the nozzle #110 of the head 42A.

The printer driver computes the distance d1 between the $k^{th}$ raster line and the rule r1 in the paper-width direction (nozzle array direction) and the distance d2 between the $k^{th}$ raster line and the rule r2 in the paper-width direction (nozzle array direction) using the image data acquired in S132. When the number of nozzles between the rule r1 and the rule r2 is set to N, the nozzle number corresponding to the $k^{th}$ raster line is expressed by the nozzle number in the position of the rule r1+N×d1/(d1+d2). When the $k^{th}$ raster line is located in the middle of the rule r1 and the rule r2 in FIG. 15 (when d1=d2), for example, the nozzle number corresponding to the $k^{th}$ raster line is #110+10×(½)=#105. In this manner, the number (k) of a raster line and the density correction value (Ck) thereof are associated with a nozzle number (#i).

Figures 16, 17:
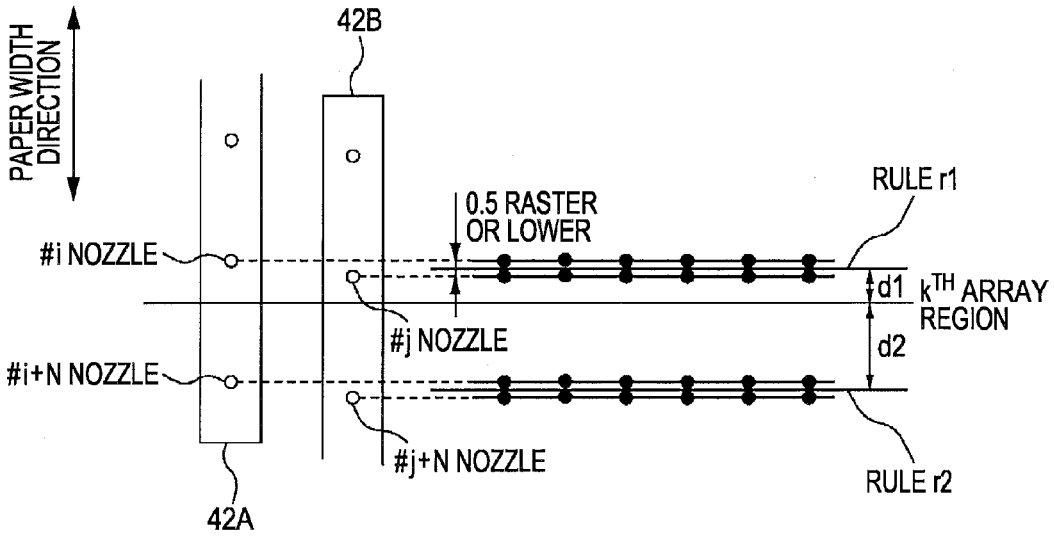
FIG. 16 is a diagram describing association of each raster number of each density correction value with each nozzle number when rules are printed by two heads (overlapping nozzles).
FIG. 17 is an example of a table indicating a corresponding relationship between density correction values, raster numbers thereof, and nozzle number of respective heads.

FIG. 16 is a diagram describing association of each raster number of each density correction value with each nozzle number when rules are printed by two heads (overlapping nozzles). In this case, the two rules are printed adjacent to each other by the overlapping nozzles of the head 42A and the head 42B. For example, the two rules are formed by the nozzle #i of the head 42A and a nozzle #j of the head 42B corresponding to the nozzle #i as shown in FIG. 16. The position in the middle of the two rules is deemed as the position of the rule r1 formed by the nozzle #i (#j). Note that, since the distance between the two corresponding nozzles (for example, the nozzle #i and the nozzle #j in FIG. 16) in the paper-width direction (nozzle array direction) when rules are printed is set to be equal to or shorter than 0.5 raster, the distance between the two rules printed by the overlapping nozzles is sufficiently short. For this reason, even if the position in the middle of the two rules is deemed as the rule position, the positions of the nozzles of each head can be accurately specified.

When the rule position is confirmed, the upper and lower rules (the rules r1 and r2 in FIG. 16) are selected for the $k^{th}$ raster line for which the correction value Ck is computed. Post processes are performed in the same manner as the method described in FIG. 15. Accordingly, the $k^{th}$ raster line and the density correction value Ck thereof are associated with the nozzles #i of each head.

FIG. 17 is an example of a table indicating a corresponding relationship between density correction values, raster numbers thereof, and nozzle number of respective heads associated in S135. In this manner, the head numbers and the nozzle numbers are associated with the density correction values and the raster numbers thereof. For example, a nozzle associated with the kth raster line as described above is the nozzle #i of the head 42A. The printer driver generates such a table equivalent to that of FIG. 17 for each ink of MCYK (in other words, for each nozzle array discharging each color ink), and causes it to be stored in a storage medium such as the memory 63, or the like. Association of raster lines that are targets of density correction of a printed image and nozzles that are in charge of the raster lines becomes easy by storing the data in the table.

S104: Application of Density Correction Value of $k^{th}$ Rater Line to $X^{th}$ Array Region of Image Data The printer driver associates the raster number (k) of the density correction value corresponding to the nozzle #i and the array region number (x) of the image data referring to the table of FIG. 12 obtained in S102 ad the table of FIG. 17 obtained in S103. Accordingly, the density correction value (BRS correction value in the $k^{th}$ rater line) for the $x^{th}$ array region of the image data is decided. With use of the tables, appropriate density correction values can be efficiently allocated to each array region of the image data. Then, density of the image data is appropriately corrected according to the density correction values.

After the density correction of the image data is completed, the image data after the correction is transmitted to the printer 1 by the printer driver, and an image is thereby printed.

Effect of Embodiment

In the present embodiment, when the raster numbers of the density correction values and the nozzle numbers are associated, the test patterns printed based on the array reference using nozzles including overlapping portions of two nozzle arrays and rules printed adjacent to the test patterns are used. The density correction values of each of the raster lines are computed from the density of each of the raster lines of the test patterns. Then, the positions of the nozzles included in each head are respectively specified from the positions of the rules, and associated with the positions of the raster lines for which the density correction values are computed. Accordingly, with reference to the positions of the rules, the density correction values of each of the raster lines can be accurately associated with the positions of the nozzles of each head, and thus, density irregularity occurring when inks are discharged from the nozzles can be effectively suppressed. In addition, since density correction is performed based on the test patterns printed with the array reference, an image having satisfactory quality in which a position shift or color mixing is not conspicuous can be printed.

Modification Example 1

A modification example (Modification Example 1) of test patterns and rules printed in the process of associating density correction values for each array region and each nozzle (S103) will be described.

Figure 18:
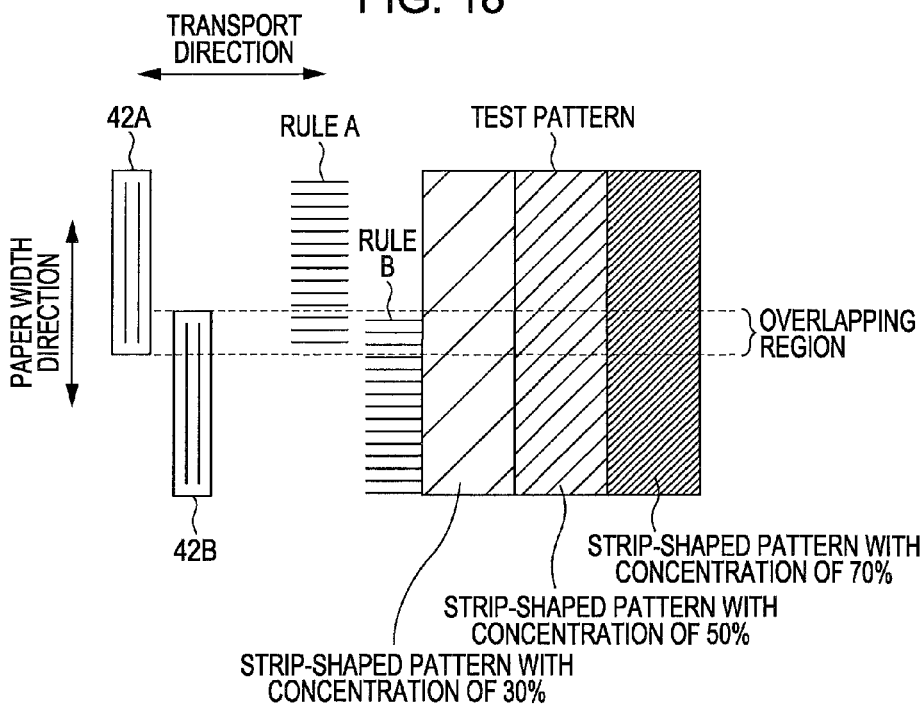
FIG. 18 is a diagram showing a test pattern in Modification Example 1.

FIG. 18 is a diagram showing test patterns in Modification Example 1. The test patterns themselves are the same as that described in FIG. 14, but the rule part is different. In Modification Example 1, rules A are printed by the head 42A, and rules B are printed by the head 42B. Then, in the portion other than the overlapping region of the two heads, density correction values and raster numbers (k) thereof, and nozzle numbers (#i) of each head are associated in the same method as in the process 5135 described above. On the other hand, in the overlapping region, the raster number are separately associated with the nozzle numbers for each head.

Figure 19:
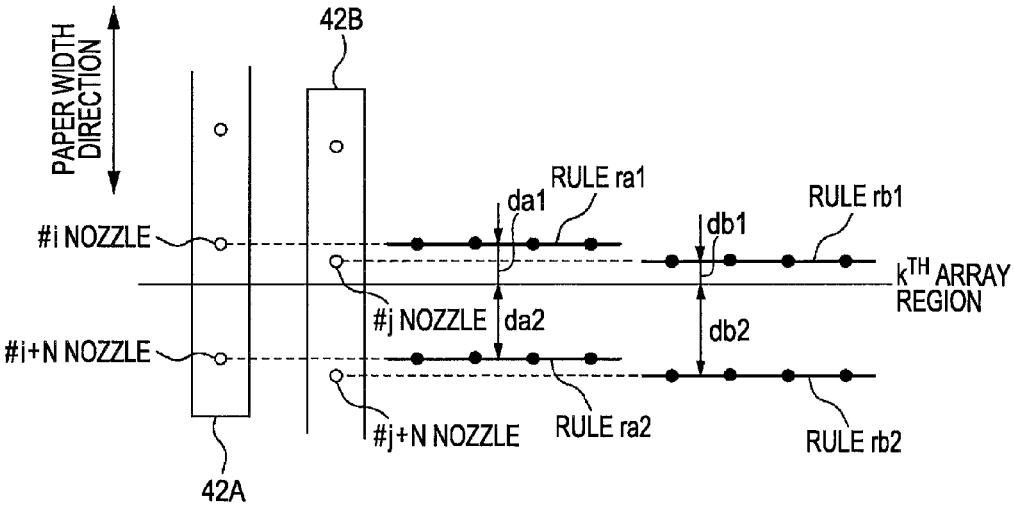
FIG. 19 is a diagram describing association of raster numbers of density correction values and nozzle numbers when rules are printed by overlapping nozzles in Modification Example 1.

FIG. 19 is a diagram describing association of raster numbers of density correction values and nozzle numbers when rules are printed by overlapping nozzles in Modification Example 1. In the drawing, a rule ra1 is printed by the nozzle #i of the head 42A, and a rule ra2 is printed by a nozzle #i+N. In addition, a rule rb1 is printed by a nozzle #j of the head 42B and a rule rb2 is printed by a nozzle #j+N. Then, the nozzle numbers of the nozzles included in the head 42A are associated with the $k^{th}$ raster line based on the rules ra1 and ra2. The associating method is the same as that described in FIG. 15 above, and the nozzle number corresponding to the $k^{th}$ raster line is decided from the relationship between the distance da1 from the $k^{th}$ raster line to the rule ra1 and the distance da2 from the $k^{th}$ raster line to the rule ra2. In addition, in the same manner, the nozzle number of a nozzle included in the head 42A is associated with the $k^{th}$ raster line based on the rules rb1 and rb2.

With printing of rules separately by respective heads, the corresponding relationship between the positions of the rules and the positions of respective nozzles in the head overlapping region is easily clarified.

Modification Example 2

Another modification example (Modification Example 2) of test patterns and rules printed in the process of associating density correction values for each array region and each nozzle (S103) will be described.

Figure 20:
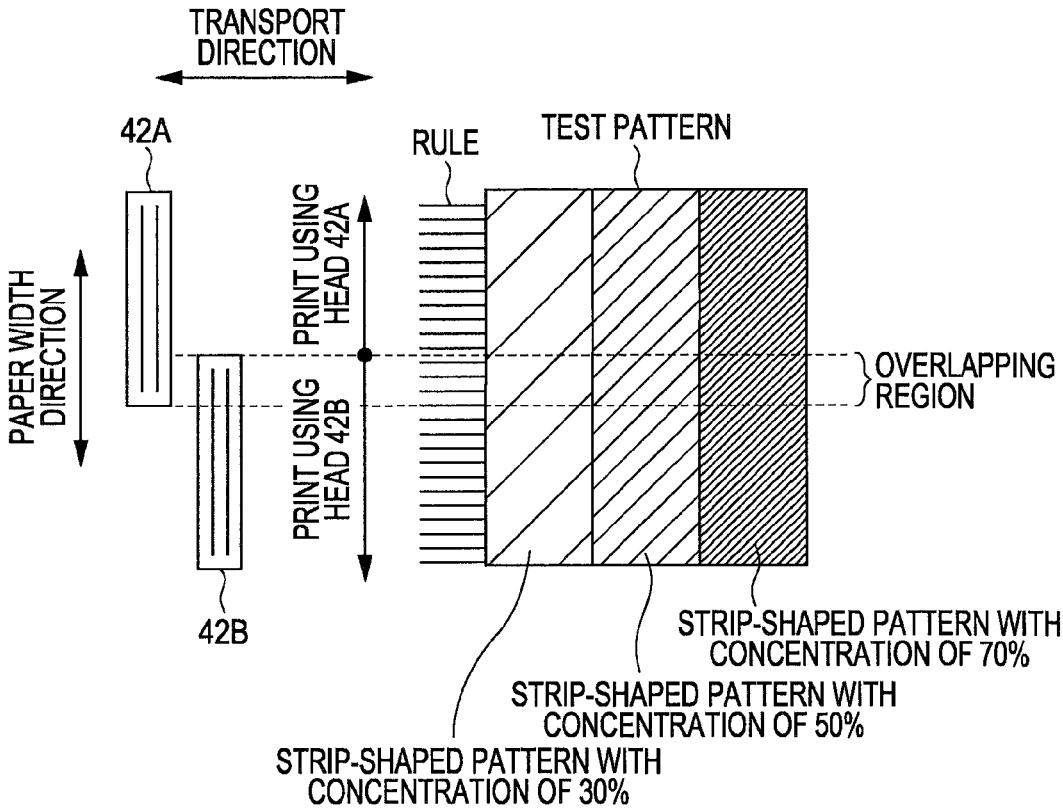
FIG. 20 is a diagram showing a test pattern in Modification Example 2.

FIG. 20 is a diagram showing test patterns in Modification Example 2. The test patterns themselves are the same as that described in FIG. 14, but the rule part is different. In Modification Example 2, rules are printed only using a head on one side in the overlapping region. In the drawing, the rules in the overlapping region are printed by nozzles included in the head 42B, but the rules in the overlapping region may be printed by nozzles included in the head 42A.

In the portion other than the overlapping region, density correction values and raster numbers (k) thereof, and nozzle numbers (#1) of each head are associated as described in the process of S135 above. In addition, in the overlapping region, raster numbers (k) for each nozzle of the head 42B and nozzle numbers (#i) of the head 42B are associated. Then, the nozzle positions (positions in the paper-width direction) of respective nozzles of the head 42A in the overlapping region are specified referring to the distances of the rules (for example, 10-nozzle distances) formed in the region above the overlapping region, and then the raster numbers (k) and the nozzle numbers (#i) are associated.

With printing of rules in the overlapping region of the heads only using a head on one side, the number of rules printed in the overlapping region reduces, and association of rules with nozzles become easy.

Other Embodiment

A printer and a controlling device thereof have been described as an embodiment, but the above-described embodiments are merely for facilitating understanding of the invention, and do not limitedly interpret the present invention. The present invention can be modified and improved without departing from the gist thereof, and it is needless to say that equivalents to the present invention are included therein. Particularly, any embodiment described hereinafter belongs to the invention.

Regarding Printing Apparatus

As an example of a printer controlled by the print control device in the embodiments described above, a so-called line printer, which prints images by discharging inks from a fixed head unit onto a medium transported in the transport direction, has been described, but the printer is not limited thereto. For example, a serial-type printing apparatus that prints by alternately repeating medium transport operations and ink discharge operations while moving a head or a printing apparatus that discharges inks while transporting a medium by rotating a transport drum may be possible.

Regarding Ink to be Used

In the above-described embodiments, the example in which inks of four colors of MCYK are used for printing has been described, but the invention is not limited thereto. For example, inks of colors other than MCYK such as light cyan, light magenta, white, a clear color may be used for printing.

Regarding Nozzles

In the above-described embodiments, the example in which inks are discharged from nozzles driven by a piezoelectric element (piezo element) has been described. However, the method for discharging inks is not limited thereto. For example, other method such as a method of generating foam in nozzles using heat may be used.

Regarding Disposition of Nozzle Array

The nozzle arrays in the head unit are lined in order of MCYK along the transport direction, but the invention is not limited thereto. For example, the orders of the K nozzle array and the Y nozzle array may be changed, or a configuration in which the number of a disposed specific nozzle array is different from that of other nozzle arrays such that the two K nozzle arrays are disposed may be adopted.

Regarding Medium

In the above-described embodiments, the medium to which a fluid is discharged from nozzles is paper. However, the medium is not limited to paper. For example, a fabric, an OHP sheet, a liquid crystal substrate, a semiconductor wafer, or the like may be used.

Regarding Printer Driver

In the above-described embodiments, the processes of the printer driver are performed by the computer 110, but may be performed by the printer itself by installing the printer driver in the controller 60 of the printer 1. In this case, the printer 1 is configured to include the print control device.

What is claimed is:

1. A print control device that controls a printing apparatus including a first nozzle array in which a plurality of nozzles that discharge an ink are lined in a predetermined direction, and a second nozzle array in which a plurality of nozzles that discharge the ink are lined in the predetermined direction and some of the nozzles are disposed in an overlapping position overlapping some nozzles of the first nozzle array in the predetermined direction, the print control device being configured to control the printing apparatus to print a test pattern by using the nozzles included in the first nozzle array and the second nozzle array, the test pattern having a plurality of dot arrays arranged in the predetermined direction, each of the dot arrays being formed along an intersecting direction intersecting with the predetermined direction, to print a plurality of rules disposed in the predetermined direction so as to be adjacent to the test pattern by using the nozzles included in the first nozzle array and the second nozzle array, to compute density correction values of each of raster lines according to density of each of the raster lines lined in the predetermined direction, the density of each of the raster lines being detected from image data of which the test patterns are read, and to associate at least one position of the nozzles included in the first nozzle array and the second nozzle array, which is specified from positions of the rules, with a position of a first raster line of the raster lines for which the density correction values are computed, by selecting a first rule and a second rule based on the rules, the first rule and the second rule being located adjacent to the first raster line in the predetermined direction such that the first raster line is located between the first rule and the second rule in the predetermined direction, by calculating a first distance between the first rule and the first raster line in the predetermined direction, and a second distance between the second rule and the first raster line in the predetermined direction, and by specifying the position of the first raster line relative to the nozzles by using the first distance and the second distance.

2. The print control device according to claim 1, wherein the test patterns are printed by adjusting pixel arrays of the image data actually allocated to the respective nozzles so that a shift amount in the predetermined direction between a pixel array on the image data allocated to each nozzle when each nozzle included in the first nozzle array and the second nozzle array is disposed in an ideal position and a pixel array on the image data actually allocated to each nozzle included in the first nozzle array and the second nozzle array is a half or smaller than the distance between two nozzles adjacent to each other in the first nozzle array or the second nozzle array.

3. The print control device according to claim 1, wherein, in an overlapping portion of the first nozzle array and the second nozzle array in which some of the nozzles of the first nozzle array and some of the nozzles of the second nozzle array are overlapped with respect to each other in the predetermined direction, the position of the first raster line and the position of the at least one of the nozzles are associated with reference to a middle position in a middle of a position of a rule printed by the first nozzle array and a position of a rule printed by the second nozzle array in the predetermined direction.

4. The print control device according to claim 3, wherein, the first rule corresponds to the middle position, and the first distance is a distance between the first raster line and the middle position in the predetermined direction, in the overlapping portion of the first nozzle array and the second nozzle array.

5. The print control device according to claim 1, wherein, in an overlapping portion of the first nozzle array and the second nozzle array in which some of the nozzles of the first nozzle array and some of the nozzles of the second nozzle array are overlapped with respect to each other in the predetermined direction, a position of one of the nozzles included in the first nozzle array is associated with the position of the first raster line with reference to a position of a rule printed by the first nozzle array, and a position of one of the nozzles included in the second nozzle array is associated with the position of the first raster line with reference to a position of a rule printed by the second nozzle array.

6. The print control device according to claim 1, wherein, in the overlapping portion of the first nozzle array and the second nozzle array, the rules are printed by nozzles included in either nozzle array of the first nozzle array or the second nozzle array.

7. The print control device according to claim 1, wherein, the first rule and the second rule are printed by the first nozzle array.

8. A non-transitory computer readable media that causes a print control device that controls a printing apparatus including a first nozzle array in which a plurality of nozzles that discharge an ink are lined in a predetermined direction, and a second nozzle array in which a plurality of nozzles that discharge the ink are lined in the predetermined direction and some of the nozzles are disposed in an overlapping position overlapping some nozzles of the first nozzle array in the predetermined direction to execute a density correction process with functions of printing a test pattern by using the nozzles included in the first nozzle array and the second nozzle array, the test pattern having a plurality of dot arrays arranged in the predetermined direction, each of the dot arrays being formed along an intersecting direction intersecting with the predetermined direction, printing a plurality of rules disposed in the predetermined direction so as to be adjacent to the test pattern by using the nozzles included in the first nozzle array and the second nozzle array, computing density correction values of each of raster lines according to density of each of the raster lines lined in the predetermined direction, the density of each of the raster lines being detected from image data of which the test patterns are read, and associating at least one position of the nozzles included in the first nozzle array and the second nozzle array, which is specified from positions of the rules, with a position of a first raster line of the raster lines for which the density correction values are computed, by selecting a first rule and a second rule based on the rules, the first rule and the second rule being located adjacent to the first raster line in the predetermined direction such that the first raster line is located between the first rule and the second rule in the predetermined direction, by calculating a first distance between the first rule and the first raster line in the predetermined direction, and a second distance between the second rule and the first raster line in the predetermined direction, and by specifying the position of the first raster line relative to the nozzles by using the first distance and the second distance.

* * * * *